United States Patent [19]

Powell

[11] Patent Number: 4,615,480

[45] Date of Patent: Oct. 7, 1986

[54] DOCUMENT SENDING SYSTEM

[76] Inventor: Joseph L. Powell, 3544 Grant Ave., Philadelphia, Pa. 19114

[21] Appl. No.: 746,014

[22] Filed: Jun. 19, 1985

Related U.S. Application Data

[63] Continuation of Ser. No. 579,979, Feb. 14, 1984.

[51] Int. Cl.[4] ..... B65D 27/04; B65D 27/06

[52] U.S. Cl. ..... 229/71; 229/6 R; 229/73

[58] Field of Search ..... 229/71, 73, 6 R

[56] References Cited

U.S. PATENT DOCUMENTS

| | | | |
|---|---|---|---|
| 36,393 | 9/1862 | Brown | 229/71 |
| 753,943 | 3/1904 | Walsh | 229/73 |
| 1,187,258 | 6/1916 | Carr et al. | 229/73 |
| 1,387,717 | 8/1921 | Hogan | 229/71 |
| 1,405,002 | 1/1922 | Rhodes | 229/73 |
| 1,714,824 | 5/1929 | Staples | 229/71 |
| 2,941,711 | 6/1960 | Biek | 229/73 |
| 3,073,509 | 1/1963 | Schuessler | 229/73 |
| 3,288,351 | 11/1966 | Benz | 229/71 |
| 3,408,908 | 11/1968 | Berkowitz | 229/71 |
| 3,856,198 | 12/1974 | Daley | 229/71 |
| 3,899,127 | 8/1975 | Melander | 229/71 |
| 3,955,751 | 5/1976 | Mayne | 229/73 |

FOREIGN PATENT DOCUMENTS

| | | | |
|---|---|---|---|
| 711690 | 9/1941 | Fed. Rep. of Germany | 229/71 |
| 2306133 | 10/1976 | France . | |
| 2397339 | 3/1979 | France . | |
| 994 | of 1914 | United Kingdom | 229/71 |

*Primary Examiner*—Stephen P. Garbe

[57] ABSTRACT

A document sending device or system is described wherein the message bearing document contains specific locations for placing information regarding at least first and second addressees. A document container or envelope receives the message bearing document and it has at least first and second windows formed respectively in opposite sides and the windows are in registration one with the other. The locations of the address information on the document are such that with proper orientation and reorientation of the document each one of the address information locations will register with one or the other of the windows in the document container. The document sending device can also be used in conjunction with diverse forms of shipping containers, packages and the like to facilitate movement among multiple addressees.

23 Claims, 8 Drawing Figures

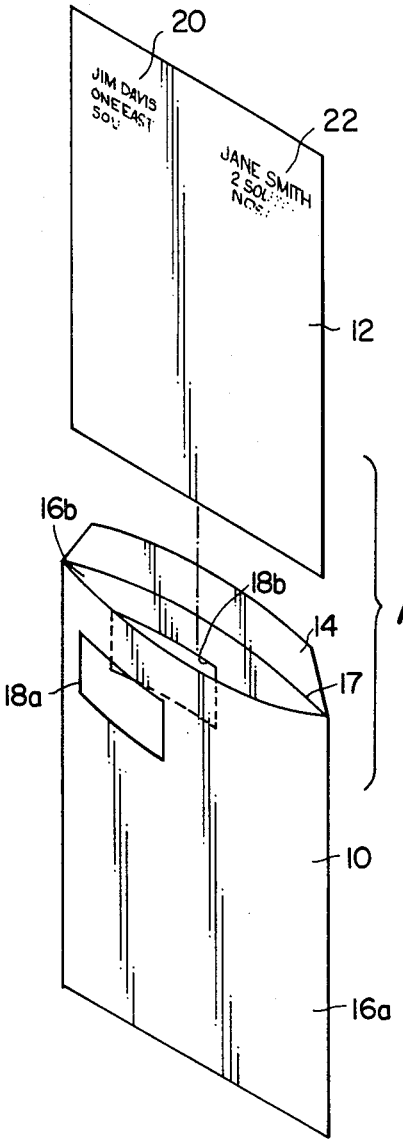
FIG. 1.
FIG. 2.
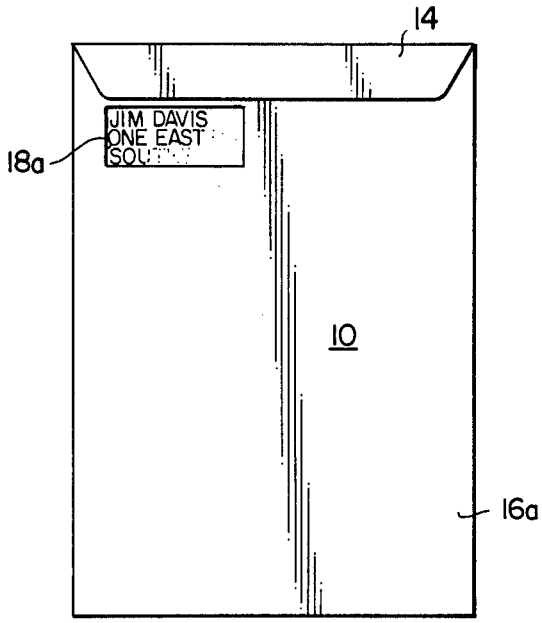
FIG. 3.
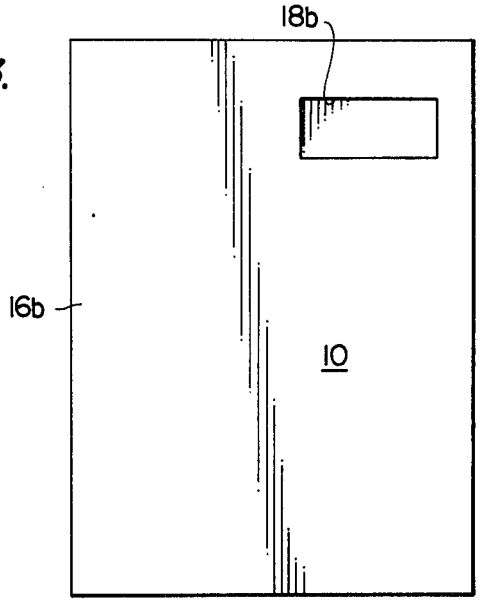
FIG. 4.
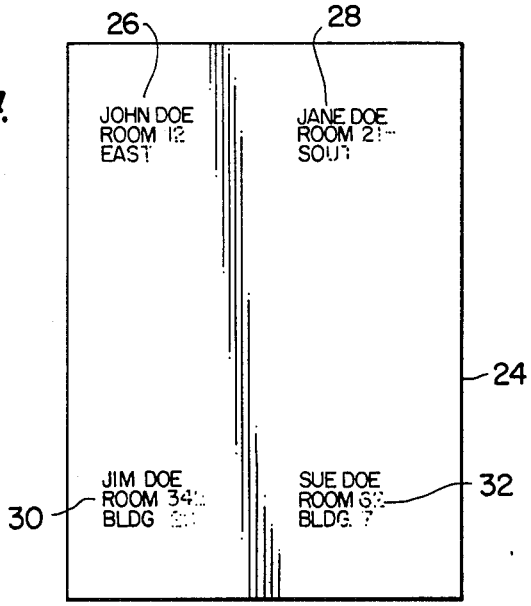

DOCUMENT SENDING SYSTEM

This is a continuation of application Ser. No. 579,979, filed on Feb. 14, 1984.

BACKGROUND OF THE INVENTION

This invention relates to a document sending device or system for providing an integrated means for users to send and return documents or for providing for serially sending a document or a container to or among multiple addressees. The device provides for the sending of documents on an inter-organization basis, intra-organization basis, or through the use of any form of delivery service or a postal system.

The present state of the art with respect to envelopes to be used for sending documents inter-organization or inter-office within an organization generally requires that senders and recipients serially cross out the last name and address on an envelope, and thereafter, write an addressee's name and location on the envelope or affix an appropriate label. If the document is to be distributed to a plurality of individuals the sender would follow this procedure for each addressee to be listed on an inter-office envelope. Obviously, the possibility for errors in using such a system are many. If, for example, the original sender is expecting to receive the document back, he must rely on the receiver of the document to properly address it back to him. Where it is expected that the document will be forwarded to a series of individuals, the original sender must often rely on each recipient subsequently accurately addressing the document to the next individual who is to properly receive it.

In connection with documents that are to go through the mails, particularly, commercial documents, similar concerns with accuracy of address information occur. For example, a shipper of goods may include an invoice which includes the address from which an item is shipped, and it may include a separate address to which payment is to be sent. It is desirable for prompt payment that the proper "pay to" address be used. Again, this places reliance on proper subsequent manual addressing which, due to human error, might not occur. For this reason senders often go to the expense of using preaddressed envelopes with prepaid postage, and then forego the inclusion of other materials simply to keep costs low.

Many of these concerns are addressed in a mailing device described in U.S. Pat. No. 3,995,751 to Mayne. However, the patented device requires that the message bearing document be a multiple sheet form having sender and receiver sections. It is necessary also that the mailing device, which is in fact a packet, include a return envelope which is properly arranged for registry with the return address information. This arrangement materially increases the cost and complexity of the documents being sent, although it may satisfy the concern of proper subsequent addressing for return to an original sender only.

An example of another approach to the problem is found in U.S. Pat. No. 4,245,755 to Conn wherein is described a two-way postal card and envelope that is designed to be mailed and then subsequently returned to the original sender. Again, this is a device which provides for automatic readdressing or subsequent addressing thereby removing the concern for errors; it is a solution which materially increases the cost and complexity of the documents and envelopes which must be sent.

It is therefore an object of this invention to provide an improved means for sending otherwise conventional documents and for providing for the automatic readdressing or subsequent addressing of the document to insure that it is properly forwarded without increasing the cost of complexity of the document and container arrangement that is used.

It is another object of this invention to provide a simple, flexible, standardization of input and output areas on any form of document which will permit use by multiple addressees, and with users of any level of sophistication. This will eliminate the problem of users searching documents for relevant addressee information, and allow diverse users to share machine readable documents for input while allowing all addressees thereon to communicate with each other without the need to readdress document or envelope container.

It is another object of this invention to provide for the automatic reuse of intra-organization and inter-organization envelopes/containers without the need for addressees having to rewrite and/or readdress documents or containers. For example, the conventional "Memo from the desk of" becomes a working document among all addressees thereon.

It is another object of this invention to provide an improved document sending device which meets the foregoing object and lends itself to a wide variety of applications.

SUMMARY OF THE INVENTION

The foregoing and other objects are achieved in a document sending device wherein a specific arrangement of addressee information on a conventional document is used and wherein a container for the document, such as an envelope, has appropriately arranged windows which will, respectively, register with differing addressee information locations upon selective reorientation of the document in the container. In a preferred form the document container is an envelope having, respectively, windows on its front and back sides, which windows are in registration with each other. First and second addressee information locations are positioned on the message bearing document so that a first addressee location will register with the first window and a second addressee location will register with the second window upon reorientation of the message bearing document in the container. This arrangement can be used to accommodate a larger number of addressees. The system described above lends itself to use in connection with documents to be sent through the mails through the use of envelopes having separately located windows to, respectively, register with the various addressee information locations. The system of the invention can be used, as well, on items such as file folders, portfolios or the like, or by affixing an envelope constructed according to the invention on a package or the like.

BRIEF DESCRIPTION OF THE DRAWINGS

The principles of the invention will be more readily understood by reference to the description of preferred embodiments given hereinbelow in conjunction with the drawings which are briefly described as follows.

FIG. 1 is a perspective view of a message bearing document and document container formed according to the principles of the invention.

FIG. 2 is a plan view of the FIG. 1 embodiment illustrating one side thereof following complete insertion of the document in the document container.

FIG. 3 is a plan view illustrating the reverse side of the FIG. 2 embodiment.

FIG. 4 is a plan view of an alternative embodiment of the message bearing document used with the invention.

FIG. 6 is a perspective view of an alternative embodiment of the invention illustrating its application in connection with file folders, proposal or report covers and the like.

DETAILED DESCRIPTION OF THE PREFERRED EMBODIMENTS

Figure 5:
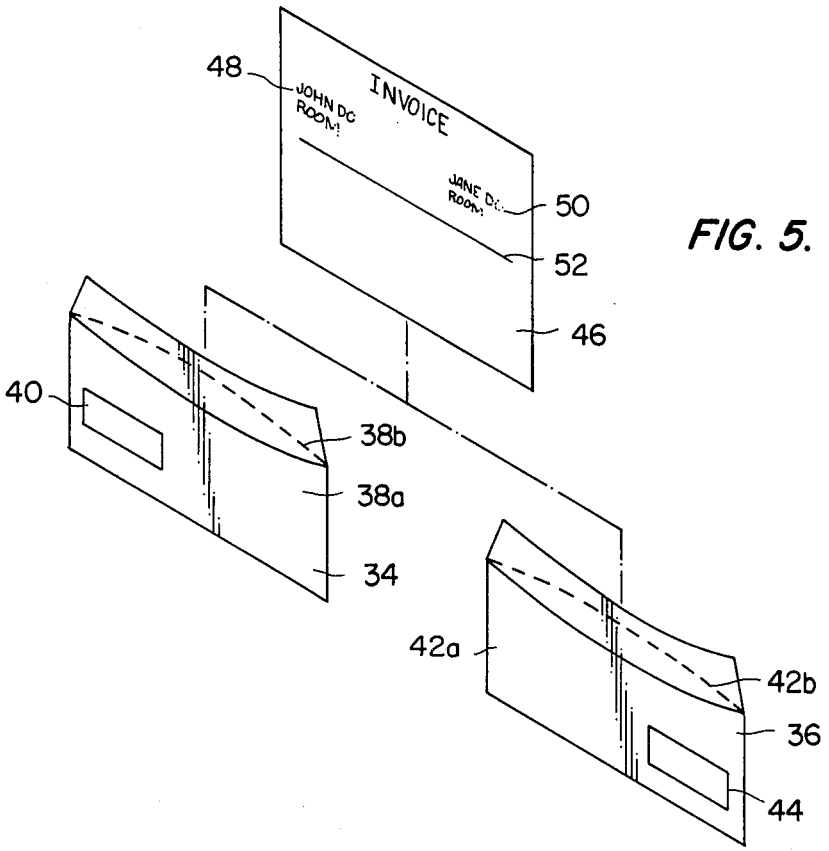
FIG. 5 is a perspective view of an alternative embodiment of the system of the invention for use in transmitting documents through the mails.

In FIG. 1 is shown in perspective a document container 10 and a message bearing document 12. Document container 10 is in the form of an envelope having in this case a sealable flap 14. The envelope has, respectively, front and back sides 16*a* and 16*b*. Flap 14 is arranged along an upper edge 17 of back side 16*b*. Windows 18*a* and 18*b* are formed, respectively, in front side 16*a* and back side 16*b*. This windows are in alignment one with the other as to be in registration so that in effect, when no document is in the envelope, there is an unimpeded view through both sides of the envelope through these windows.

Message bearing document 12 can be of any desired form; it might be a memorandum, invoice, purchase order, conventional or inverted voucher check or a business letter or the like. In connection with the description of this preferred embodiment, message bearing document will be considered an inter-office memorandum to be sent to a recipient and returned to the sender. This document includes a first location for addressee information 20, and a second location 22 for other addressee information. In this example, location 22 bears the address of the sender, while location 20 bears the address information for the recipient.

FIGS. 2 and 3 illustrate document 12 fully inserted in envelope 10 in the shown orientation. As can be seen from FIG. 2, addressee information location 20 is in registration with window 18*a*. Thus, the envelope with the document will be transmitted to the recipient by virtue of the use of this particular address information. FIG. 3 illustrates the back side of envelope 10 with the document 12 inserted as in FIG. 2. This merely illustrates the fact that no address information will appear in window 18*b* with this orientation of the document.

It will now be appreciated that upon receipt and review the recipient can return this same document to the sender simply by reversing the document side for side in the envelope. Thus, although not shown, the address information appearing at location 22 will be seen through window 18*b*, and this information will be used in this case to return the document to the sender. Addressee information locations 20 and 22 are arranged at like vertical positions and spaced horizontally to register with the respective envelope windows.

FIG. 4 illustrates an alternative embodiment of the message bearing document 24. In this embodiment it will be seen that there are four addressee information locations 26, 28, 30 and 32. This illustrates that the system of the invention can be used with a message bearing document having a plurality of addressee information locations on its face. In this emnbodiment if document 24 were to be inserted into envelope 10 in its illustrated orientation addressee information location 26 would register with window 18*a*, and should the document be reversed side for side addressee information location 28 would register with window 18*b*. At this point, to send the document further it will be necessary to reverse it end for end so that addressee information location 30 will register with window 18*b*, and addressee information location 32 will register with window 18*a* upon subsequent side for side reversal of the document. Again, the respective addressee information locations are spaced to register with the respective envelope windows as described above. The message bearing document of FIG. 4 also illustrates an example of the reverse side of the message bearing document of FIG. 1 for another embodiment of the present invention wherein addresses information locations or addresses are positioned on both sides of the document.

FIG. 5 illustrates a second alternative embodiment of the invention wherein the principles of the invention are utilized in connection with documents to be sent through the mails or any similar service where a sending fee is involved. In this instance it may be undesirable or not permitted for there to be used a document container, such as envelope 10 in FIG. 1, wherein windows placed in the front and back sides of the envelope are in registration. The postal authorities may not permit reversal of an envelope on which postage has been already placed and used unless the original postage is blocked-out in some way. Accordingly, in order to overcome any such objection should it appear, it is necessary that differing envelopes be used having different window locations. In the FIG. 5 example conventional letter envelopes 34 and 36 are used. Envelope 34 has formed in a first side thereof 38*a* a window 40 in this case on the left hand portion of side 38*a*. Envelope 36 including sides 42*a* and 2*b* has formed in the right hand portion of side 42*a* a window 44.

In this embodiment message bearing document 46 is shown as being an invoice having first and second addressee locations 48 and 50. This document is intended to be folded along line 52 for insertion in either of envelopes 34 or 36. First addressee location 48 is arranged on document 46 so that when it is folded along line 52 and placed in envelope 34 addressee location 48 will be in registration with window 40. Second addressee information location 50 is arranged on document 46 so that when the document is placed in envelope 36 addressee information location 50 will be in registration with window 44.

If this embodiment is to be used, it is possible that one of envelopes 34 and 36 could be included with a packet sent in the other of the envelopes. Preferably, users of the system of the invention can be supplied with both forms of the envelope for either originating, returning or sending on such documents.

Figure 6:
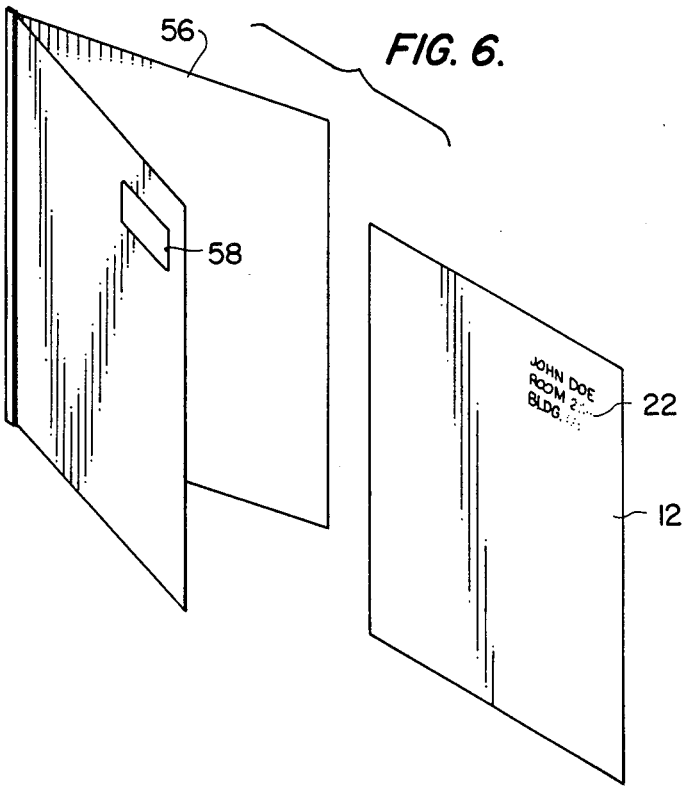

FIG. 6 illustrates a third alternative embodiment of the invention simply illustrating that documents such as message bearing document 12 can be used in connection with a file folder or the like 56. Window 58 in this embodiment would then be in registration with addressee information location 22. This embodiment of the invention merely illustrates the compatibility of the system of the invention with ordinary file folders or binders to eliminate the need for addressing word processing, computer output and other reports. It is contemplated, as well, that windows on front and back covers in an arrangement such as shown in FIG. 1 might be used.

Figure 7:
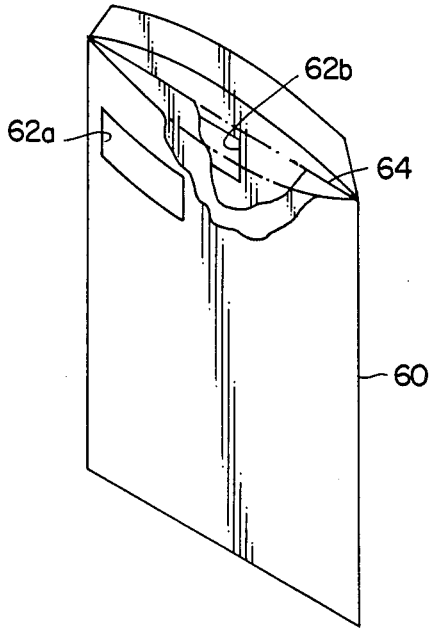
FIG. 7 is a perspective view of an additional alternative embodiment of the document container to be utilized with message bearing documents bearing more addressee information on both sides of the document.

FIG. 7 is a perspective view of another alternate embodiment of an envelope to be used with the system of the invention. The envelope 60 having windows 62*a* and 62*b* with one exception is constructed similarly to envelope 10. In this embodiment, as shown, a divider 64 is added. Divider 64 permits additional addressee or other information locations to be placed on a reverse side of a document, such as documents 12 and 24. Thus, selective orientation of the document on one or the other side of the divider as well as reversing the document side for side and end for end will permit the use of more than four addressee information locations. Even more addressee locations are possible on each side of larger sized documents.

Figure 8:
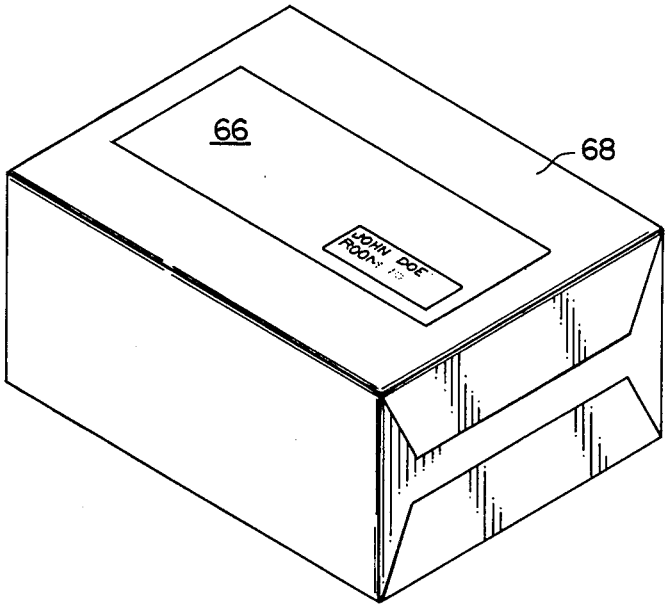
FIG. 8 is a perspective view illustrating another application of the FIG. 5 embodiment wherein one of the FIG. 5 envelopes is affixed to a package.

FIG. 8 is a perspective view of another embodiment of the invention showing that the invoice, or packing slip, can be placed in a weatherproof envelope 66 similar to FIG. 5 for sending a shipment to an addressee by attaching it to package 68. The addressee can use a copy of the originator's document and appropriate envelope if merchandise must be returned for any reason. The envelope in FIG. 1 could, likewise, be used for similar purposes.

Another embodiment of this invention will allow users to place a document in compatible windows of diverse boxes, cartons, and packages without the need to enclose the document in an envelope. For example, FIG. 2 could be the top lid of a carton and FIG. 3 could be the bottom half of the carton with similar window so document with addressee information thereon can be placed on tope of contents of carton, corner mount cuts inside carton lid and bottom, or outer ply of carton window pockets.

It can be seen that the system of the invention substantially eliminates the risk of inserting enclosures in a wrong envelope. Similarly, it eliminates recopying of addresses with the corresponding possibilities of mislabeling, transpositions or the like which will result in the document being sent to a wrong addressee. It is contemplated that through the use of the system of the invention productivity of clerical employees can be significantly increased. Moreover, these results are achieved without significantly increasing the cost and complexity of the packet of materials which must be sent.

It will be understood that the exemplary embodiments described hereinabove are indeed only examples and that many changes or modifications can be made in these embodiments without departing from the spirit and scope of the invention. For example, it is contemplated that a variety of relative placements of document container windows and addressee information locations can be used to accommodate varying orientations of envelopes and documents. The specific locations of these elements described herein are intended only to provide examples of appropriate placements. Moreover, it is contemplated that the principles of the invention can be utilized in connection with document containers and documents of all types of materials without exeption.

I claim:

1. A document sending device comprising:

a message bearing document bearing first and second spaced addresses, a document container having front and back sides for receiving said message bearing document therein, said document container having first and second windows formed, respectively, in said front and back sides, said first and second windows being in registration with one another, said first and second addresses being positioned on said message bearing document for said first address to register with said first window and be readable therethrough upon insertion of said message bearing document in said document container in a first orientation relative thereto and for said second address to register with said second window and be readable therethrough upon insertion of said message bearing document in said document container in a second orientation relative thereto different from said first orientation, and said second address being in non-registration with said second window when said document is in said first orientation.

2. The device of claim 1 including, said first and second addresses being positioned on opposite sides of a central axis of said message bearing document when said message bearing document is ready for insertion into said document container.

3. The device of claim 2 including, said central axis being a vertical axis of said message bearing document.

4. The device of claim 2 including, said central axis being a horizontal axis of said message bearing document.

5. The device of claim 1 including, said first and second addresses being on the same side of said message bearing document at, respectively, like vertical positions thereon.

6. The device of claim 5 including, third and fourth addresses positioned on the same side of said message bearing document as said first and second addresses at, respectively, like vertical positions thereon, and said first and second addresses being located vertically and spaced one from the other for said third address to register with said second window when said document is reversed end for end in said document container and for said fourth address to register with said first window when the sides of said document are reversed.

7. The device of claim 1 including, said document container having a closable flap along at least one of its container edges.

8. The device of claim 1 including, said message bearing document having opposite first and second document sides, and said first and second addresses being positioned, respectively, on said first and second document sides.

9. The device of claim 1 including, said first and second addresses both being positioned on the same side of said document.

10. The device of claim 1 including, said message bearing document bearing third and fourth spaced addresses, and said message bearing document having four quadrants, and said first, second, third and fourth addresses each being positioned in a different said quadrant.

11. The device of claim 10 including, said fourth quadrants being positioned on the same side of said message bearing document.

12. The device of claim 10 including, said first, second, third and fourth addresses being oriented in the same direction on said message bearing document.

13. The device of claim 12 including, said message bearing document bearing a message oriented in the same direction as said addresses.

14. The device of claim 13 including, said message and said first, second, third and fourth addresses being positioned on the same side of said document.

15. The device of claim 10 including, said document container having four quadrants on said front side thereof, and said first window being positioned generally entirely in one of said four quadrants.

16. The device of claim 1 including, said document container being an envelope.

17. The device of claim 16 including, said envelope having one side thereof adhered at least partially along its perimeter to a container larger than said envelope.

18. The device of claim 17 including, said one side being the front side of said envelope.

19. The device of claim 17 including, said one side being the back side of said envelope.

20. The device of claim 1 including, said document container being a folder.

21. The device of claim 1 including, said document container being a box.

22. A method of sending a document comprising the following steps:

providing a message bearing document bearing first and second addresses, providing a document container having front and back sides, and first and second windows formed, respectively, in said front and back sides and in registration with each other, inserting said message bearing document into said document container so that said first address is in registration with and readable through said first window, thereafter, delivering said document container with said message bearing document therein to said first address, thereafter, removing said message bearing document from said document container, thereafter, inserting said message bearing document into said document container in a reoriented position such that said second address is in registration with and readable through said second window, and thereafter, delivering said document container with said message bearing document therein to said second address.

23. A method of sending a document comprising the following steps:

providing a message bearing document bearing first, second, third and fourth spaced addresses, providing a document container having front and back sides, and first and second windows formed, respectively, in said front and back sides and in registration with each other, inserting said message bearing document into said document container in a first orientation relative thereto so that said first address is in registration with and readable through one said window, thereafter, delivering said document container with said message bearing document therein to said first address, thereafter, removing said message bearing document from said document container, thereafter, inserting said message bearing document into said document container in a second orientation different from said first orientation such that said second address is in registration with and readable through one said window, thereafter, delivering said document container with said message beaing document therein to said second address, thereafter, inserting said message bearing document into said document container in a third orientation relative thereto different from said first and second orientations so that said third address is in registration with and readable through one said window, thereafter, delivering said document container with said message bearing document therein to said third address, thereafter, removing said message bearing document from said document container, thereafter, inserting said message bearing document into said document container in a fourth orientation different from said first, second and third orientations such that said fourth address is in registration with and readable through one said window, and thereafter, delivering said document container with said message bearing document therein to said fourth address.

* * * * *